US009254444B1

(12) United States Patent
Toomey

(10) Patent No.: US 9,254,444 B1
(45) Date of Patent: Feb. 9, 2016

(54) BALLOON BURSTING SYSTEM AND DEVICE

(71) Applicant: Rocky Toomey, East Providence, RI (US)

(72) Inventor: Rocky Toomey, East Providence, RI (US)

( * ) Notice: Subject to any disclaimer, the term of this patent is extended or adjusted under 35 U.S.C. 154(b) by 0 days.

(21) Appl. No.: 14/228,753

(22) Filed: Mar. 28, 2014

Related U.S. Application Data

(60) Provisional application No. 61/878,873, filed on Sep. 17, 2013.

(51) Int. Cl.
*A63H 27/10* (2006.01)
*A63F 9/00* (2006.01)

(52) U.S. Cl.
CPC ..... *A63H 27/10* (2013.01); *A63F 2009/0083* (2013.01); *A63F 2009/0084* (2013.01)

(58) Field of Classification Search
CPC ..... A63F 2009/0084; A63F 2009/0083
USPC ..... 446/220, 484; 472/51, 53; 83/866, 575, 83/577, 153, 192, 411.5, 687
See application file for complete search history.

(56) References Cited

U.S. PATENT DOCUMENTS

| | | | | |
|---|---|---|---|---|
| 4,900,020 | A * | 2/1990 | Rehkemper et al. | 273/458 |
| 5,021,022 | A * | 6/1991 | Ganz | 446/220 |
| 6,305,258 | B1 * | 10/2001 | Henderson et al. | 83/13 |
| 6,402,582 | B1 * | 6/2002 | Sherer | 446/220 |
| 2011/0301629 | A1 * | 12/2011 | Manabe | 606/182 |
| 2012/0080469 | A1 * | 4/2012 | Souders | 224/600 |

* cited by examiner

*Primary Examiner* — Rayshun Peng
(74) *Attorney, Agent, or Firm* — Salter & Michaelson

(57) ABSTRACT

A device for bursting an amusement balloon, and that includes a housing having sides that define an open bottom leading into an internal chamber; tape or the like for securing the housing to an outer surface of the balloon in an orientation so that the open bottom of the housing is directed at the outer surface of the balloon; and an electro-mechanical member supported in the internal chamber of the housing. The electro-mechanical member includes a movable plunger having respective rest and extended positions. A puncture pin is carried by the plunger. The electro-mechanical member is activated so as to move the plunger from the rest position to the extended position thereof so as to move the puncture pin against the outer surface of the balloon to puncture the balloon. The activation can be either hard wired or wireless.

21 Claims, 6 Drawing Sheets

BALLOON BURSTING SYSTEM AND DEVICE

RELATED CASE

Priority for this application is hereby claimed under 35 U.S.C. §119(e) to commonly owned U.S. Provisional Patent Application No. 61/878,873 which was filed on Sep. 17, 2013 and which is incorporated by reference herein in its entirety.

FIELD OF THE INVENTION

The present invention relates in general to a device for puncturing and thus bursting a balloon or a series of balloons. The device of the present invention is in particular for use in the amusement field.

BACKGROUND OF THE INVENTION

At the present time, for amusement purposes, a series of balloons may be burst by means of a detonator. For example, refer to U.S. Pat. No. 5,538,451. The device shown in this patent actually uses the principle of exploding the balloon. One drawback to this arrangement is a clear safety aspect in that pyrotechnics are typically used which can create an unsafe condition. Mechanical means also exist for bursting a balloon such as shown in U.S. Pat. No. 6,402,582. However, these existing mechanical means have been found to be ineffective and not readily controllable particularly when it is desired to activate the bursting action remotely.

Accordingly, it is an object of the present invention to provide an improved technique for bursting a balloon or a series of balloons.

Another object of the present invention is to provide an improved system and device for effectively bursting a balloon and that may be readily controlled either remotely or with a hard-wired arrangement.

Still another object of the present invention is to provide an improved system and device for effectively bursting a balloon and which is economical to produce, easy to set-up and operate and which is extremely effective in carrying out any one of a number of different bursting sequences.

SUMMARY OF THE INVENTION

To accomplish the foregoing and other objects, features and advantages of the present invention there is provided a device for bursting an amusement balloon, comprising: a housing having sides that define an open bottom leading into an internal chamber; means for securing the housing to an outer surface of the balloon in an orientation so that the open bottom of the housing is directed at the outer surface of the balloon; and an electro-mechanical member supported in the internal chamber of the housing. An electro-mechanical member includes a movable plunger having respective rest and extended positions. A puncture means is carried by the plunger. Means are provided for selectively energizing the electro-mechanical member so as to move the plunger from the rest position to the extended position thereof so as to move the puncture means against the outer surface of the balloon to puncture the balloon.

In accordance with other aspects of the present invention the means for securing the housing to an outer surface of the balloon includes at least one piece of tape; the housing also includes a pair of tabs extending from opposed sides of the housing at the open bottom; the means for securing the housing to an outer surface of the balloon includes a pair of pieces of tape each for securing a side of the housing to the outer surface of the balloon; the electro-mechanical member comprises a solenoid including a solenoid frame that is secured to an inner surface of the housing, said solenoid controlling the action of the plunger; the puncture means comprises a sharpened pin capable of bursting the balloon when engaged against the outer surface of the balloon; the means for selectively energizing said electro-mechanical member comprises a hard wired system including an activation button that is hard wired to the electro-mechanical member; or the means for selectively energizing the electro-mechanical member comprises a wireless system including a remote transmitter and a receiver that is connected with the electro-mechanical member; including a safety lanyard attached to the housing for support of the housing from an overhead object; and wherein the housing has a passage for receiving one end of the safety lanyard.

In accordance with another embodiment of the present invention there is provided a system for remotely bursting a series of amusement balloon. The system comprises: a plurality of housings each having sides that define an open bottom leading into an internal chamber; means for securing each housing to an outer surface of each balloon in an orientation so that the open bottom of the housing is directed at the outer surface of the balloon; and a plurality of electro-mechanical members each supported in the internal chamber of a respective housing. Each said electro-mechanical member includes a movable plunger having respective rest and extended positions. A plurality of puncture means each is carried by a respective plunger, and means are provided for selectively energizing the electro-mechanical members in concert so as to move all the plungers from the rest position to the extended position thereof so as to move the puncture means against the outer surface of all balloons to concurrently puncture all the balloons.

In accordance with still other aspects of the present invention the means for securing the housing to an outer surface of the balloon includes at least one piece of tape; each said housing also includes a pair of tabs extending from opposed sides of the housing at the open bottom; the means for securing the housing to an outer surface of the balloon includes a pair of pieces of tape each for securing a side of the housing to the outer surface of the balloon; each electro-mechanical member comprises a solenoid including a solenoid frame that is secured to an inner surface of each said housing, each said solenoid controlling the action of the plunger; the puncture means comprises a sharpened pin capable of bursting each of the balloons when engaged against the outer surface of the balloon; the means for selectively energizing the electro-mechanical members comprises a hard wired system including an activation button that is hard wired to all the electro-mechanical members for concurrent activation thereof; or the means for selectively energizing the electro-mechanical member comprises a wireless system including a remote transmitter and a receiver that is connected with all the electro-mechanical members; including a safety lanyard attached to the housing for support of the housing from an overhead object; and wherein the housing has a passage for receiving one end of the safety lanyard.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which:

FIG. 5 is a simple block diagram of the remote activation via a iPhone or the like.

DETAILED DESCRIPTION

The concept of the present invention is to develop an actuation mechanism for bursting a balloon and particularly such as a mechanism that preferably includes a "Bluetooth" or "wireless" mechanism that will "pop" a balloon, or series of balloons, on cue. This mechanism hereinafter may be referred to as a "stinger". The stinger is preferably a reusable device needing only a small coin like cell battery to power a solenoid that carries a sharp point. Upon cue, the solenoid pushes the pin to contact the balloon and, boom, the balloon pops.

Figure 1A:
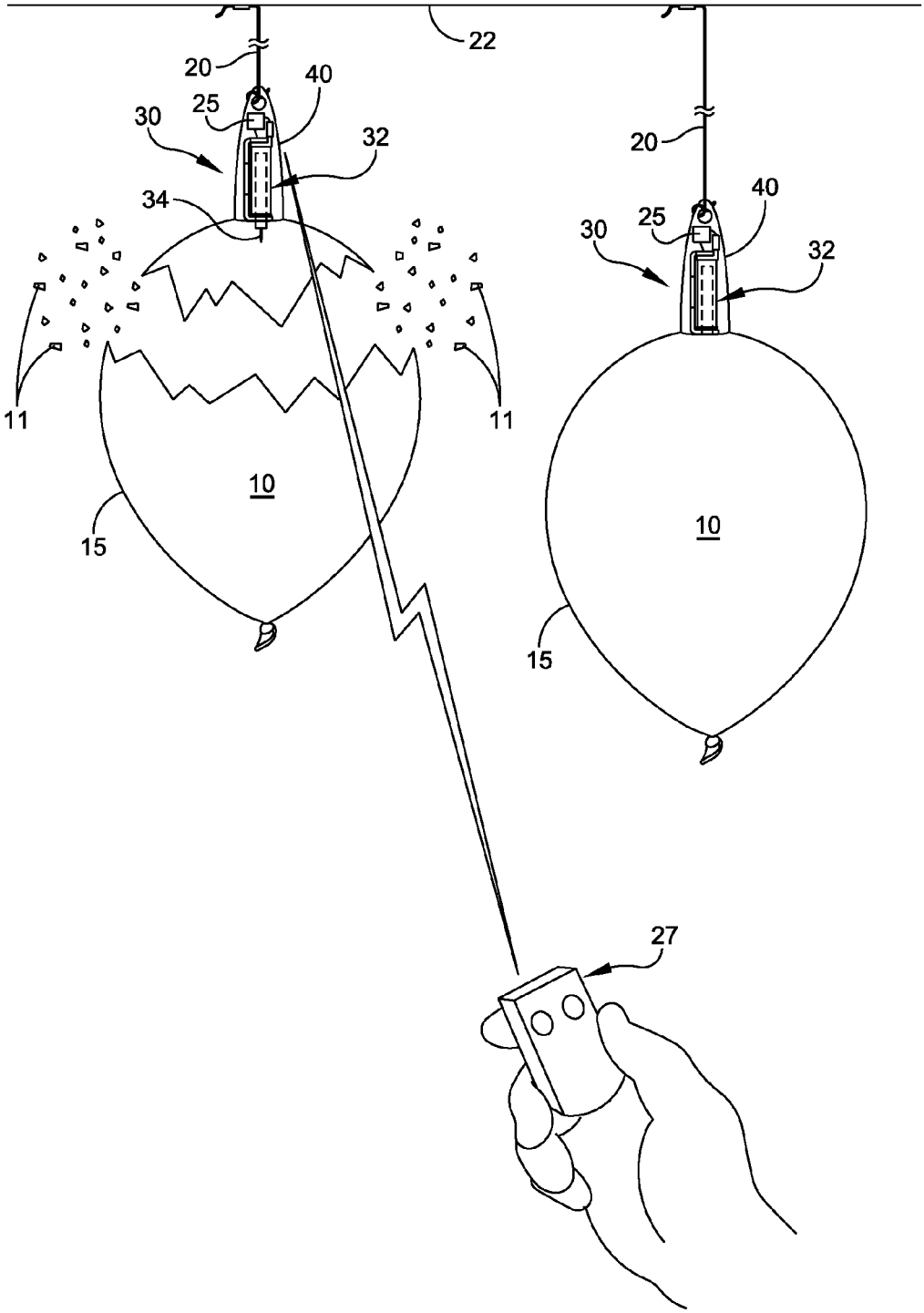
FIG. 1A is a schematic illustration of one embodiment of the present invention in which the balloon or balloons can be remotely burst.
Figure 1B:
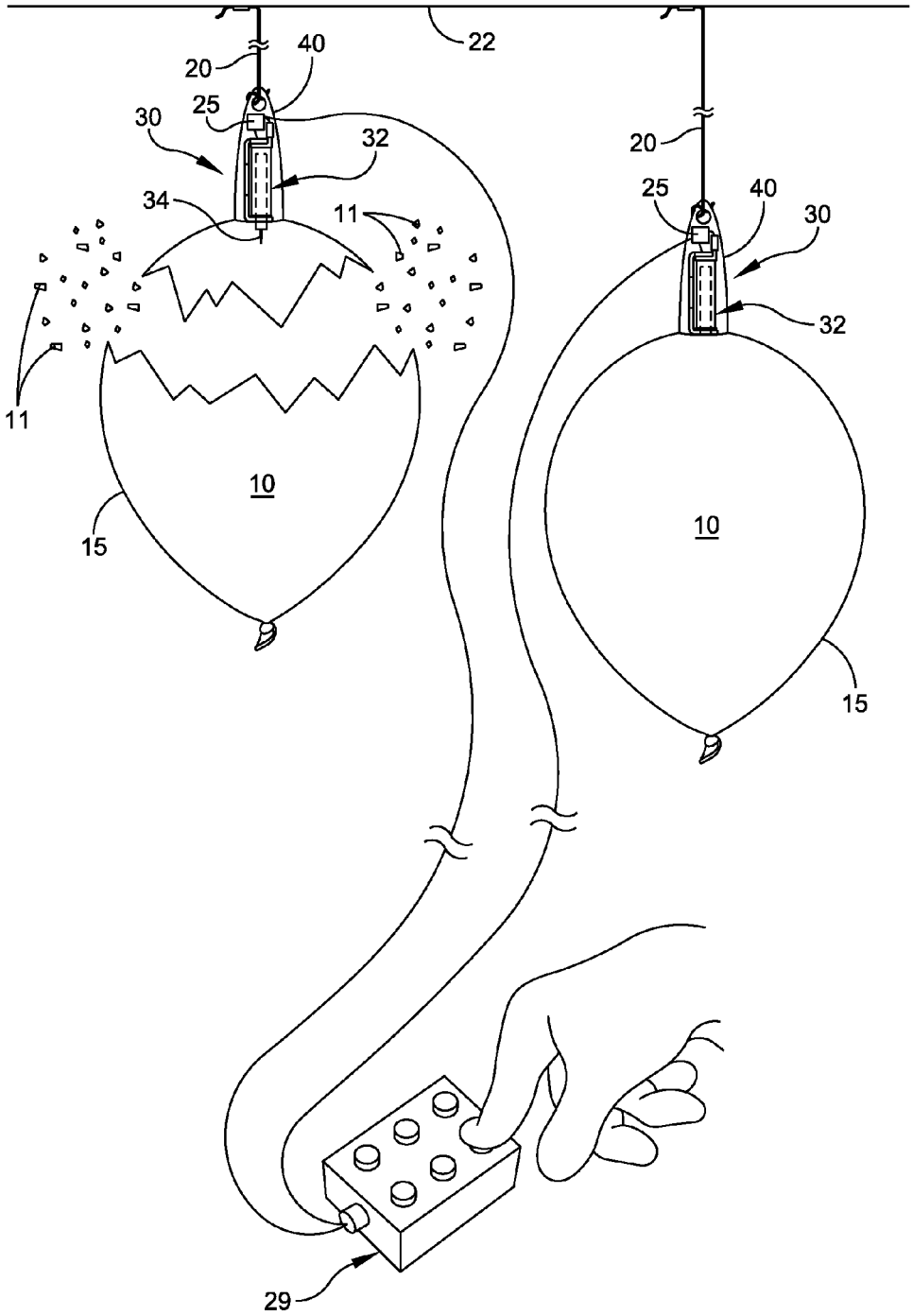
FIG. 1B is a schematic illustration of another embodiment of the present invention in which the balloon or balloons can be burst by a hard-wired means.

FIGS. 1A and 1B illustrate opposed options which enable a puncture of the balloon either remotely (FIG. 1A) such as by way of a wireless device or smart phone see FIG. 1A and device 27. FIG. 1B also illustrates an option with a hard-wired arrangement also including a small device that pops the balloon on cue. This may be activated from a push button device as described hereinafter. See FIG. 1B and device 29. The device 29 is depicted in FIG. 1B as having multiple buttons. This device could also have a single button for activation of all balloons concurrently. Alternatively, multiple buttons may be used as part of the device 29 with each button for controlling only a predetermined number of stingers 30. In this way different groups of balloons can be burst depending upon the particular button selected.

Figure 5:
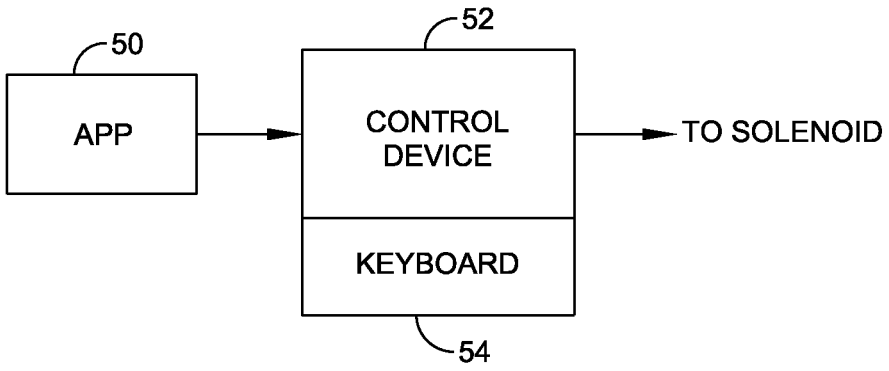

In accordance with the present invention, the stinger 30 may be activated by downloading an APP on to the iPhone (only once). In this connection refer to the block diagram of FIG. 5 that shows the APP 50 being downloaded to the control device 52. When using the APP, there would be a wireless code entered into the control device 52 or more particularly the iPhone at the code input means or keyboard 54. Once the broadcast code is entered, each receiver will activate the solenoid that is attached to each balloon. This can be one balloon or 10,000 balloons. They all preferably receive the same signal at the same time. This causes a common bursting of all balloons providing the desired effect. Alternatively, the control in accordance with the present invention may provide any one of a number of different sequences for activating the balloons. This may include using different codes that will be associated with a particular series of balloons in which only those balloons burst upon entry of that predetermined code. Then, a different code can be used for activating other balloons.

Figure 3:
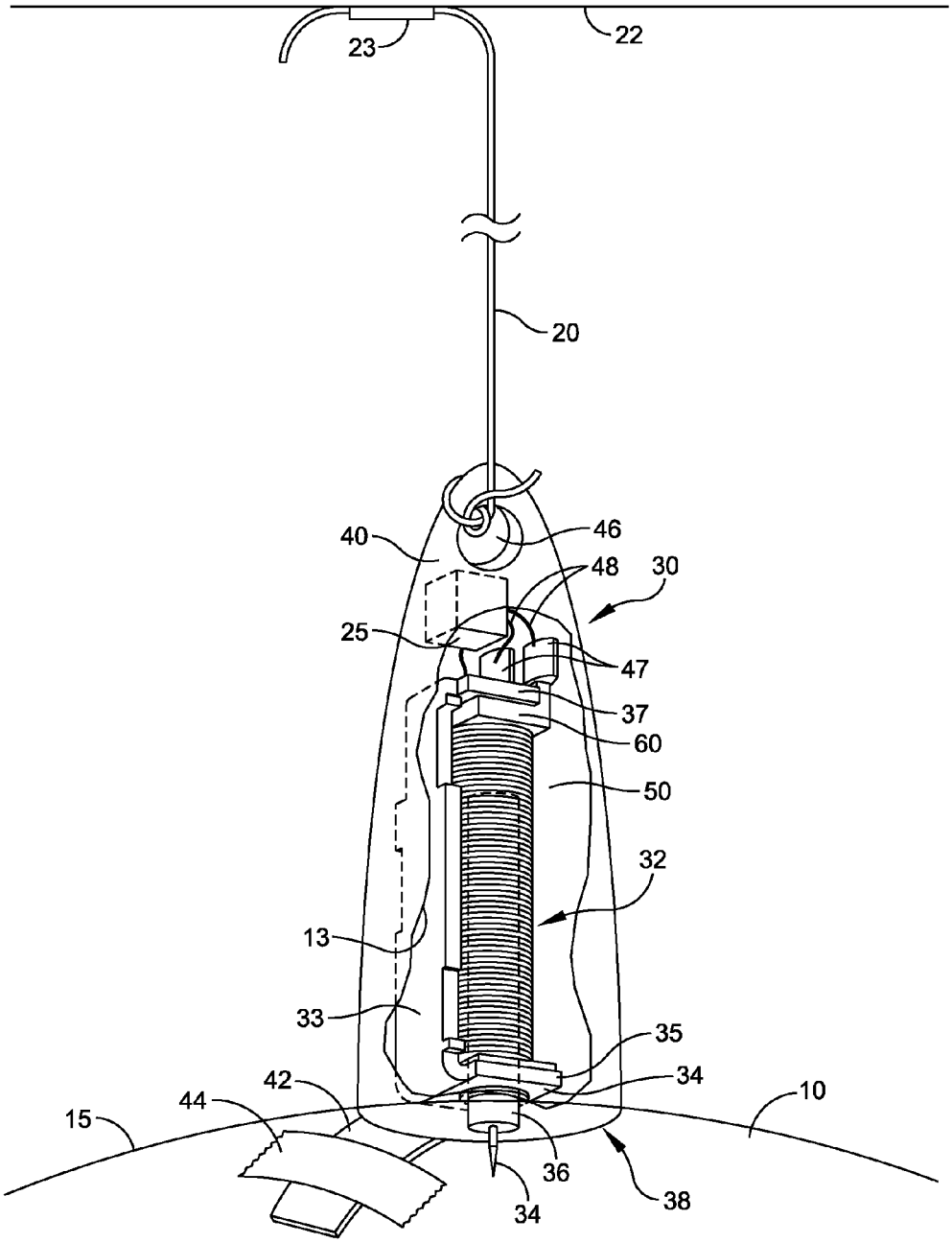
FIG. 3 is a more detailed perspective view particularly of the solenoid and associated support components showing the attachment to the balloon and the tethering of the balloon to another object such as a ceiling member.
Figure 4:
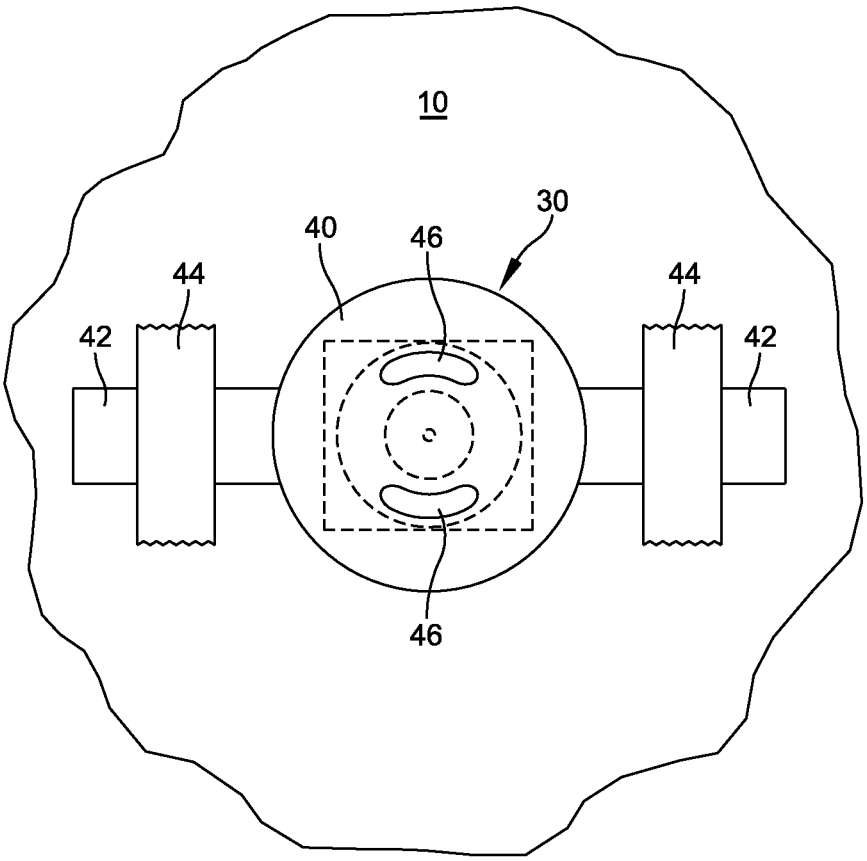
FIG. 4 is plan view of the device of FIG. 3.

This stinger 30 is meant to be attached to a regular ordinary latex balloon 10. The size of this balloon can vary over a substantial size range. For example, the balloons can range in general diameter from 11 inches to 16", 36" and 60". The reason for the stinger to pop the balloon on cue is to release anything that is in the balloon. For example, FIG. 1A shows confetti at 11 being expelled from the balloon 10 upon the bursting of the balloon. The balloon 10 can be filled with any number of different items, such as the following:

Other smaller balloons
Confetti
Foam balls
T-shirts
Lighted parachutes
Diamond Banner Drop The stinger 10 may be attached to the balloon 10 quite easily with the use of a standard clear packing tape as illustrated in FIGS. 3 and 4. Each stinger 10 has a safety lanyard 20 that may be attached to a location in the ceiling preventing it from falling once the balloon pops. This lanyard or cable 20 is also illustrated in FIG. 3 attached to a ceiling location, such as at 22, and by the use of an appropriate attachment means 23.

Refer also to FIGS. 2 and 3 for an illustration of the device of the present invention which is comprised of a small solenoid 32. The solenoid supports a needle or pin 34 as also illustrated in the drawings herein. The needle is preferably replaceable (removable) as it may become dulled or become unsharp over a period of time.

The solenoid is positioned by means of the securing tape or tabs (one on either side of the housing) so that the solenoid, in its non-powered position, is directly in contact with the surface of the balloon but the needle is withdrawn so that no piercing of the balloon occurs. When a signal to the bluetooth power source is provided, the solenoid pushes the pin forward. The sharpness of the pin or needle immediately pops the balloon by virtue of direct linear motion contact with the balloon outer surface, as illustrated in, for example, FIG. 1A.

Preliminary tests show the prototypes have a 100% success rate, which is very important and the activation command is at 1 mSec. For redundancy, the system operates to send the activation wireless code several times, such as 10 times in a row, as a fail-safe mode or operation.

As illustrated in FIGS. 3 and 4, the solenoid 32, needle 34, power source and receiver 25 are enclosed in an injection molded plastic case or housing 40 that is adapted for easy access to replace the battery and needle as needed. Also illustrated in FIGS. 3 and 4, are the plastic tabs or wings 42. These are for use for the purpose of attachment of the housing to the balloon outer surface. This fixes the position of the stinger relative to the balloon by the means of opposed tape pieces 44 extending over respective wings 42. The design is compact and sleek in appearance.

Figure 2A:
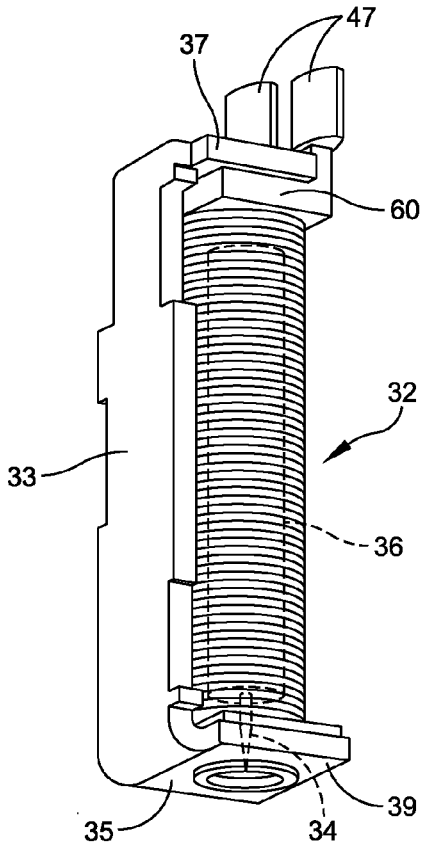
FIG. 2A is a perspective view of the needle and solenoid arrangement of the present invention in an inactive state.
Figure 2B:
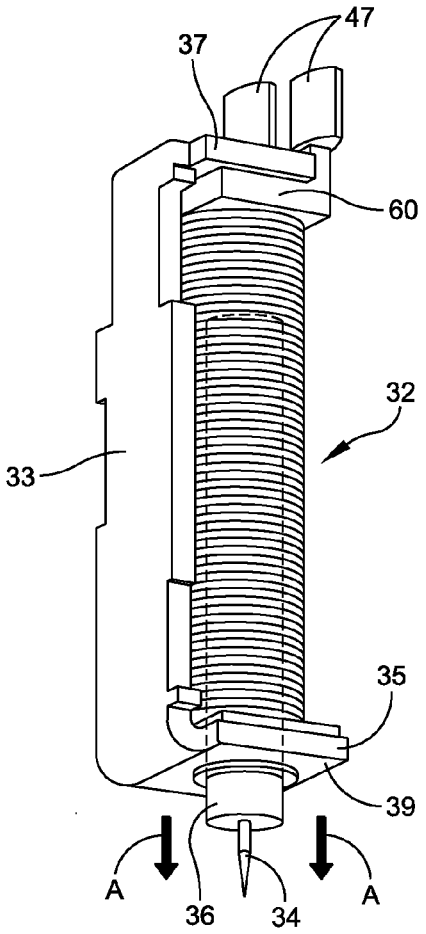
FIG. 2B is a perspective view of the needle and solenoid arrangement of the present invention in an active state.

Reference is now made to FIGS. 2A, 2B and 3 for further details of the electro-mechanical member which is basically comprised of the solenoid 32 and an associated support structure which includes a main support plate or frame 33 having contiguous therewith a lower end support plate 35 and an upper end support plate 37. The top end of the solenoid may include a support piece 60 including tabs 47 clearly illustrated in FIG. 3. The tabs 47 may be used for the connection of wiring 48 for the wireless version. In this regard note in the cut-away view of FIG. 3 there is a portion of the receiver 25 shown having wiring connect to the tabs 47 and in turn to the solenoid 32 for selective activation of the solenoid.

With further reference to FIGS. 2A and 2B, it is noted that the lower end support plate 35 is provided with a contact surface 39 that is meant to be in engagement with the outer surface 15 of the balloon 10. FIG. 2A shows the plunger 36 and needle 34 in a rest position with the needle 34 disposed away from the balloon surface. On the other hand, FIG. 2B illustrates the activation of the solenoid which causes the plunger 36 to move in the direction of arrows A so that the needle or pin 34 punctures through the balloon skin.

One of the aspects of the present invention is that the electro-mechanical member be relatively firmly attached to an inner wall or surface defining the housing 40. For this purpose the somewhat elongated main support plate 33 is appropriately secured to an inner surface 13 of the housing 10. For example, an adhesive may be used or other fastening members that are not specifically illustrated herein. The frame is supported so that the bottom contact surface 39 is disposed at the open bottom 38 of the housing or it may be slightly disposed outside of the opening 38 so that proper contact can be made of the electro-mechanical member with the balloon surface. Again, it is primarily the surface 39 that makes contact with the balloon surface. The solenoid is supported so that this positioning occurs within the housing.

Another possible alternate support for the electro-mechanical member is by means of the tabs 47 that are illustrated in FIGS. 2A, 2B and 3. The reverse side of these tabs could be secured to an inner surface 13 of the housing, although, it is preferred to have a more substantial support such as provided by the main support frame 33.

FIGS. 3 and 4 also illustrate a pair of aligned holes 46 at the very top of the housing 40. These holes can be used for attachment of the lanyard 20. The top end of the lanyard 20 is preferably secured to an overhead object such as the ceiling illustrated in FIG. 3 at 22. An appropriate attachment means 23 may be used at the top end of the lanyard for attachment to the object 22.

As indicated previously, the housing 40 has an open bottom 38 that may be considered as circular or oval in shape. The securing tabs 42 are preferably integrally connected at a bottom edged line defining the bottom of the housing. Refer to FIGS. 3 and 4. FIGS. 3 and 4 also illustrate respective pieces of tape 44 disposed across respective tabs 42. The tape pieces 44 secure the tabs to the outer surface 15 of the balloon.

Thus, in accordance with certain features of the present invention there is provided a device for bursting an amusement balloon that includes a housing 10 having sides that define an open bottom 38 leading into an internal chamber 50. Means are provided for securing the housing to an outer surface 15 of the balloon in an orientation so that the open bottom of the housing is directed at the outer surface of the balloon. An electro-mechanical member 32 in the preferred form of a solenoid is supported in the internal chamber of the housing. The electro-mechanical member includes a movable plunger 36 having respective rest and extended positions. A puncture means such as the illustrated pin or needle 34 is carried by the plunger 36. Means are provided for selectively energizing electro-mechanical member so as to move the plunger 36 from the rest position to the extended position thereof so as to move the puncture means 34 against the outer surface 15 of the balloon 10 to puncture the balloon.

In accordance with still other features of the present invention there is provided a device wherein the means for securing the housing to an outer surface of the balloon includes at least one piece of tape 42. The housing also includes a pair of tabs 42 extending from opposed sides of the housing at a peripheral edge defining the open bottom 38. A pair of pieces of tape 44 may be used. The electro-mechanical member preferably comprises a solenoid 32 including a solenoid support frame 33 that may be secured to an inner surface of the housing. The solenoid 32 controls the action of the plunger 36. The means for selectively energizing the electro-mechanical member may comprise either a hard wired system including an activation button 29 that is hard wired to the electro-mechanical member, or a wireless system including a remote transmitter and a receiver that is connected with the electro-mechanical member. A safety lanyard 20 is attached to the housing for support of the housing from an overhead object 22.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A device for bursting an amusement balloon, comprising:

a housing having sides that define an open bottom leading into an internal chamber;

wherein the housing is secured to an outer surface of the balloon in an orientation so that the open bottom of the housing is directed at the outer surface of the balloon;

an electro-mechanical member supported in the internal chamber of the housing;

said electro-mechanical member including a movable plunger having respective rest and extended positions;

a puncture pin carried by the plunger;

an activation apparatus for selectively energizing said electro-mechanical member so as to move said plunger from the rest position to the extended position thereof so as to move the puncture pin against the outer surface of the balloon to puncture the balloon;

said electro-mechanical member including an elongated solenoid that carries said movable plunger and an elongated solenoid frame for supporting the elongated solenoid;

said housing formed with a substantially continuous closed cross-section that tapers from a small diameter cross-section closer to a top end thereof to a larger diameter cross-section closer to a bottom end thereof, said top end also having at least one through hole, and said open bottom of the housing being defined by a continuous closed bottom edge;

said elongated solenoid frame having a longitudinal axis extending between top and bottom ends of said housing and including an elongated main support plate extending along the longitudinal axis and secured to an inner surface of the housing;

and a safety lanyard attached, at one end thereof, through said hole in the housing and, at another end thereof, for support from an overhead object.

2. The device of claim 1 including at least one piece of tape for securing the housing to the outer surface of the balloon, and wherein the housing is formed with a substantially continuous closed cross section, and the continuous closed bottom edge of the housing is circular in shape.

3. The device of claim 2 wherein said housing also includes a pair of tabs extending from opposed sides of the housing at the open bottom edge.

4. The device of claim 3 including a pair of pieces of tape each for securing a side of the housing to the outer surface of the balloon, each piece of tape secured across a respective tab.

5. The device of claim 4 wherein the support frame also includes a lower end support plate connected with a lower end of the elongated main support plate and an upper end support plate connected with an upper end of the elongated main support plate.

6. The device of claim 5 wherein the lower end support plate extends orthogonal to the elongated main support plate, and the upper end support plate extends orthogonal to the elongated main support plate and in the same direction as the lower end support plate, and the lower end support plate has a flat bottom surface that is disposed at the open bottom edge of the housing.

7. The device of claim 1 wherein said activation apparatus comprises a hard wired system including an activation button that is hard wired to the solenoid.

8. The device of claim 1 wherein said activation apparatus comprises a wireless system including a remote transmitter and a receiver that is connected with solenoid.

9. The device of claim 6 wherein the support frame also includes a lower end support plate connected with a lower end of the elongated main support plate and an upper end support plate connected with an upper end of the elongated main support plate.

10. The device of claim 9 wherein the lower end support plate extends orthogonal to the elongated main support plate, and the upper end support plate extends orthogonal to the elongated main support plate and in the same direction as the lower end support plate, and the lower end support plate has a flat bottom surface that is disposed at the open bottom edge of the housing and is for engagement with the outer surface of the balloon.

11. The device of claim 1 including, a plurality of housings each having sides that define an open bottom leading into an internal chamber;

a plurality of electro-mechanical members each supported in the internal chamber of a respective housing;

and a plurality of puncture pins each carried by a respective plunger.

12. The device of claim 11 wherein all balloons are concurrently punctures by the respective puncture pins.

13. The device of claim 11 wherein the respective puncture pins are burst in a different sequence.

14. The device of claim 1 wherein the support frame also includes a lower end support plate connected with a lower end of the elongated main support plate and an upper end support plate connected with an upper end of the elongated main support plate.

15. The device of claim 14 wherein the lower end support plate extends orthogonal to the elongated main support plate, and the upper end support plate extends orthogonal to the elongated main support plate and in the same direction as the lower end support plate, and the lower end support plate has a flat bottom surface that is disposed at the open bottom edge of the housing and is for engagement with the outer surface of the balloon.

16. The device of claim 15 including a pair of tabs extending from opposed sides of the housing at the open bottom edge, and a pair of pieces of tape each for securing a side of the housing to the outer surface of the balloon, each piece of tape secured across a respective tab.

17. The device of claim 16 wherein each tab has a substantially rectangular shape extending longer from the housing than its length.

18. The device of claim 17 wherein each piece of tape also has a length greater than its width.

19. The device of claim 18 wherein each tape piece is longer than the width of each tab so that end portions of each piece of tape lap over on either side of the tab in order to have a section of tape piece secured to the balloon on either side of the tab.

20. The device of claim 19 including a pair of holes at the top end of the housing with the lanyard secured through both holes in supporting the housing from the overhead object.

21. A device for bursting an amusement balloon, comprising:

a housing having sides that define an open bottom leading into an internal chamber;

wherein the housing is secured to an outer surface of the balloon in an orientation so that the open bottom of the housing is directed at the outer surface of the balloon;

an electro-mechanical member supported in the internal chamber of the housing;

said electro-mechanical member including a movable plunger having respective rest and extended positions;

a puncture pin carried by the plunger;

an activation apparatus for selectively energizing said electro-mechanical member so as to move said plunger from the rest position to the extended position thereof so as to move the puncture pin against the outer surface of the balloon to puncture the balloon;

said electro-mechanical member including an elongated solenoid that carries said movable plunger and an elongated solenoid frame for supporting the elongated solenoid;

said housing formed with a substantially continuous closed cross-section having top and bottom ends, said top end having at least one through hole, and said bottom end formed as an open bottom of the housing being defined by a continuous closed bottom edge;

said elongated solenoid frame having a longitudinal axis extending between top and bottom ends of said housing and including an elongated main support plate extending along the longitudinal axis and secured to an inner surface of the housing;

and wherein said activation apparatus comprises a wireless system including a remote transmitter and a receiver that is connected with the solenoid.

* * * * *